US005816662A

United States Patent [19]

Rumburg

[11] Patent Number: 5,816,662

[45] Date of Patent: Oct. 6, 1998

[54] OVER-THE-SHOULDER SAFETY HARNESS FOR USE WITH A CHAIR

[76] Inventor: Tina M. Rumburg, 331 Fair Meadows Ct., Gastonia, N.C. 28056

[21] Appl. No.: 746,465

[22] Filed: Nov. 12, 1996

[51] Int. Cl.[6] ..... A47C 31/00; A47D 15/00

[52] U.S. Cl. ..... 297/484; 297/485; 297/467; 297/DIG. 6

[58] Field of Search ..... 297/483, 484, 297/485, 467, DIG. 6

[56] References Cited

U.S. PATENT DOCUMENTS

| | | | |
|---|---|---|---|
| 3,325,213 | 6/1967 | Levy | 297/484 |
| 3,366,294 | 1/1968 | Stephenson | 297/467 |
| 3,466,090 | 9/1969 | Posey | 297/484 |
| 4,711,487 | 12/1987 | Brooks | 297/484 |
| 5,056,869 | 10/1991 | Morrison | 297/484 |
| 5,203,613 | 4/1993 | Ward | 297/485 |
| 5,299,855 | 4/1994 | Zubeck | 297/485 |

*Primary Examiner*—Milton Nelson, Jr.
*Assistant Examiner*—Anthony D. Barfield
*Attorney, Agent, or Firm*—Adams Law Firm, P.A.

[57] ABSTRACT

An over-the-shoulder safety harness is used in combination with a chair having a back and a bottom. An elongated safety harness attachment member is located on a back side of the chair back and extends from one side of the back to the other side of the back. The safety harness includes first and second shoulder straps adapted for extending over the shoulders of the occupant. The shoulder straps have respective first and second ends. The first ends are secured to the attachment member for slidably adjustable movement along the length of the attachment member. The first and second shoulder straps define a laterally-extending occupant space therebetween. The occupant space is adjustable by sliding the first ends of the shoulder straps along the length of the attachment member. The occupant space is reduced to further restrain the occupant by sliding the straps towards each other and is increased to remove the occupant from the chair by sliding the straps away from each other. A between-the-legs attachment strap is attached to a front end of the chair bottom and secured to the second ends of the shoulder straps.

5 Claims, 6 Drawing Sheets

OVER-THE-SHOULDER SAFETY HARNESS FOR USE WITH A CHAIR

TECHNICAL FIELD AND BACKGROUND OF THE INVENTION

This invention relates to an over-the-shoulder safety/harness for use with a chair, such as an infant's high chair or booster chair. The invention is intended to confine the infant to the chair, for example, when eating, and to avoid accidents and injury by preventing the infant from standing up in the chair or attempting to exit the chair without supervision. The invention is inexpensive, relatively easy to make and use, and conveniently removable from the chair for cleaning and replacement as required.

Conventional prior art high chairs typically include a permanently attached lap belt which extends around the waist of the infant. Unlike the invention, this belt is not readily adjustable to properly fit and restrain the infant, and is relatively easily removed by the infant when left unsupervised. Moreover, the prior art belt cannot limit the forward movement of the infant in the chair, thus allowing the infant the freedom to reach for and grab breakable or spillable items on the table. Constant monitoring of the infant is generally required by the parent in order to prevent accidents.

The present invention overcomes these and other problems of the prior art by providing an over-the-shoulder safety harness for a chair which effectively confines the infant to the chair, and thereby reduces the burden on the parent of constantly monitoring and attending to the infant. The invention is quickly and conveniently adjustable to properly fit the infant, and to limit the infant from leaning forward in the chair. The invention further prevents the infant from standing up in the chair and possibly causing an accident or injury.

SUMMARY OF THE INVENTION

Therefore, it is an object of the invention to provide an over-the-shoulder safety harness for use with a chair, such as an infant's high chair, which effectively confine the infant to the chair to avoid accidents and possible injury.

It is another object of the invention to provide a safety harness which is detachable from the chair for cleaning or replacement of the harness as required.

It is another object of the invention to provide a safety harness for a chair which is conveniently adjustable to properly fit the infant.

It is another object of the invention to provide a safety harness for a chair which is readily adjustable to provide varying levels of restraint.

It is another object of the invention to provide a safety harness for a chair which effectively prevents the infant from standing up in the chair.

It is another object of the invention to provide a safety harness for a chair which effectively prevents the infant from leaning forward in the chair and grabbing breaking or spillable items.

It is another object of the invention to provide a safety harness for a chair which reduces the parent's burden of monitoring and attending to the infant when eating.

These and other objects of the present invention are achieved in the preferred embodiments disclosed below by providing an over-the-shoulder safety harness for use in combination with a chair having a back and a bottom. An elongated safety harness attachment member is located on a back side of the chair back and extends from one side of the back to the other side of the back. The safety harness includes first and second shoulder straps adapted for extending over the shoulders of the occupant. The shoulder straps have respective first and second ends. The first ends are secured to the attachment member for slidably adjustable movement along the length of the attachment member.

The first and second shoulder straps define a laterally-extending occupant space therebetween. The occupant space is adjustable by sliding the first ends of the shoulder straps along the length of the attachment member. The occupant space is reduced to further restrain the occupant by sliding the straps towards each other and is increased to remove the occupant from the chair by sliding the straps away from each other. A between-the-legs attachment strap is attached to a front end of the chair bottom and secured to the second ends of the shoulder straps.

According to one preferred embodiment of the invention, a restraint adjustment bar includes spaced-apart slots receiving the first and second shoulders straps, respectively. The bar is slidably movable along the length of the straps for further adjusting the occupant space.

According to another preferred embodiment of the invention, the second ends of the shoulder straps are integrally formed together and include a fastener member for being releasably mated with a complementary fastener member connected to the between-the-legs attachment strap.

According to yet another preferred embodiment of the invention, the between-the-legs attachment strap includes first and second free ends having complementary mating hook and loop sections for removably attaching the attachment strap to the chair bottom.

According to yet another preferred embodiment of the invention, each of the free ends of the shoulder straps includes mating sections of hooks and loops for removably attaching the free ends to the attachment member.

BRIEF DESCRIPTION OF THE DRAWINGS

Some of the objects of the invention have been set forth above. Other objects and advantages of the invention will appear as the description proceeds when taken in conjunction with the folio g drawings, in which.

DESCRIPTION OF THE PREFERRED EMBODIMENT AND BEST MODE

Figure 1:
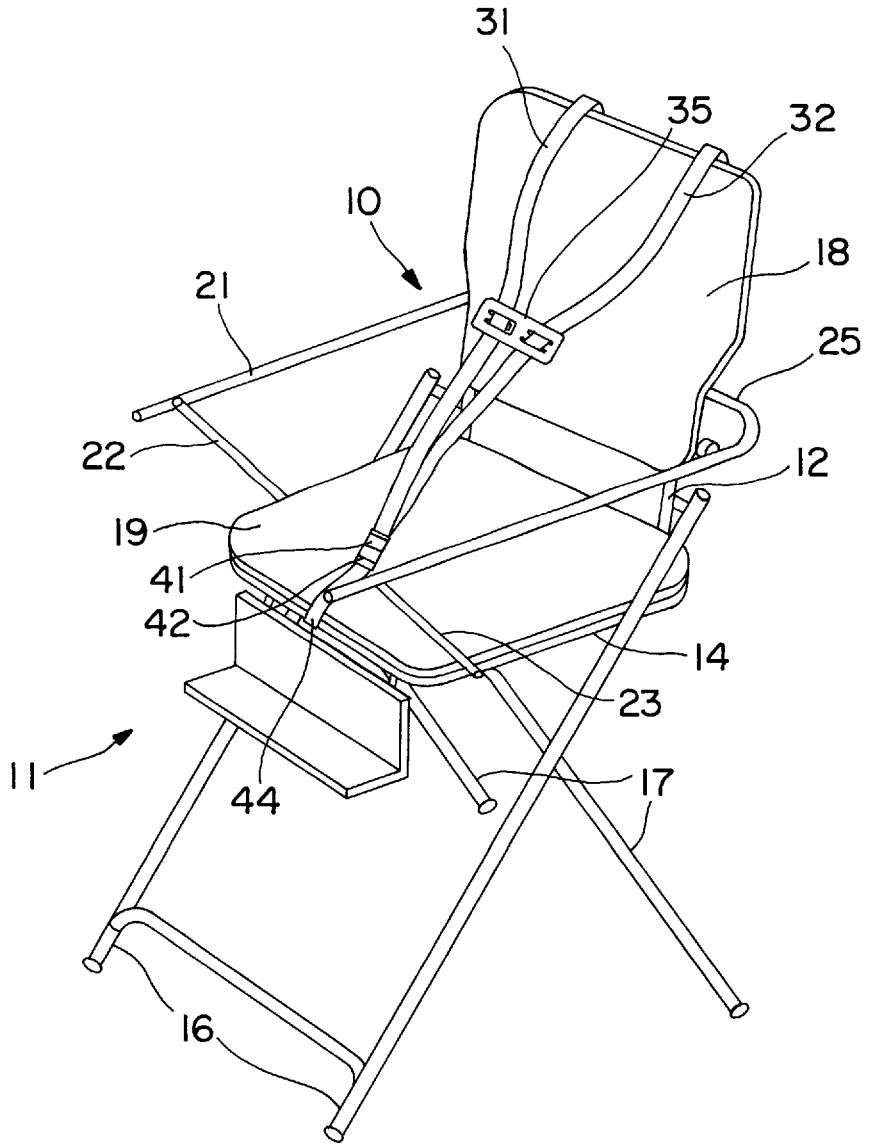
FIG. 1 is a perspective view of an infant's high chair including an attached safety harness according to one preferred embodiment of the invention.

Referring now specifically to the drawings, a safety harness according to the present invention is illustrated in FIG. 1 and shown generally at reference numeral 10. The safety harness 10 is especially adapted for use with a standard infant's high chair 11 to confine the infant to the chair 11, for example, when eating. The high chair 11 includes back and bottom generally C-shaped frame members 12 and 14 connected to front and rear sets of legs 16 and 17 and supporting the chair back 18 and chair bottom 19, respectively. A generally U-shaped armrest 21 is connected to the back frame member 12 and extends perpendicularly outwardly from the chair back 18 to the front of the chair 11. The front ends of the armrest 21 are supported by respective side frame members 22 and 23 connected to the bottom frame member 14 and located on opposite sides of the chair bottom 19. The back end of the arm rest 21 is slightly spaced apart from the rear of the chair back 18, and defines a safety harness attachment member 25 extending from one side of the chair back 18 to the other side.

Figure 2:
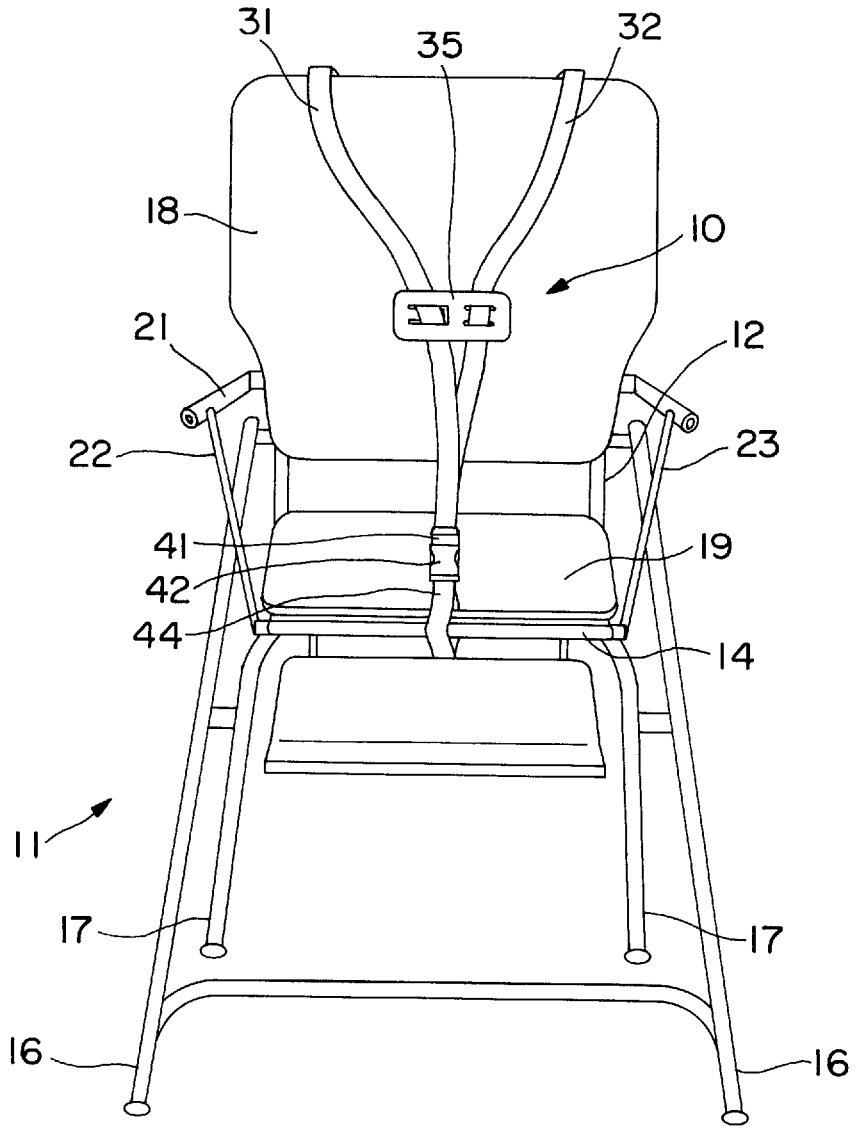
FIG. 2 is a front elevational view of the chair with the safety harness attached.
Figure 3:
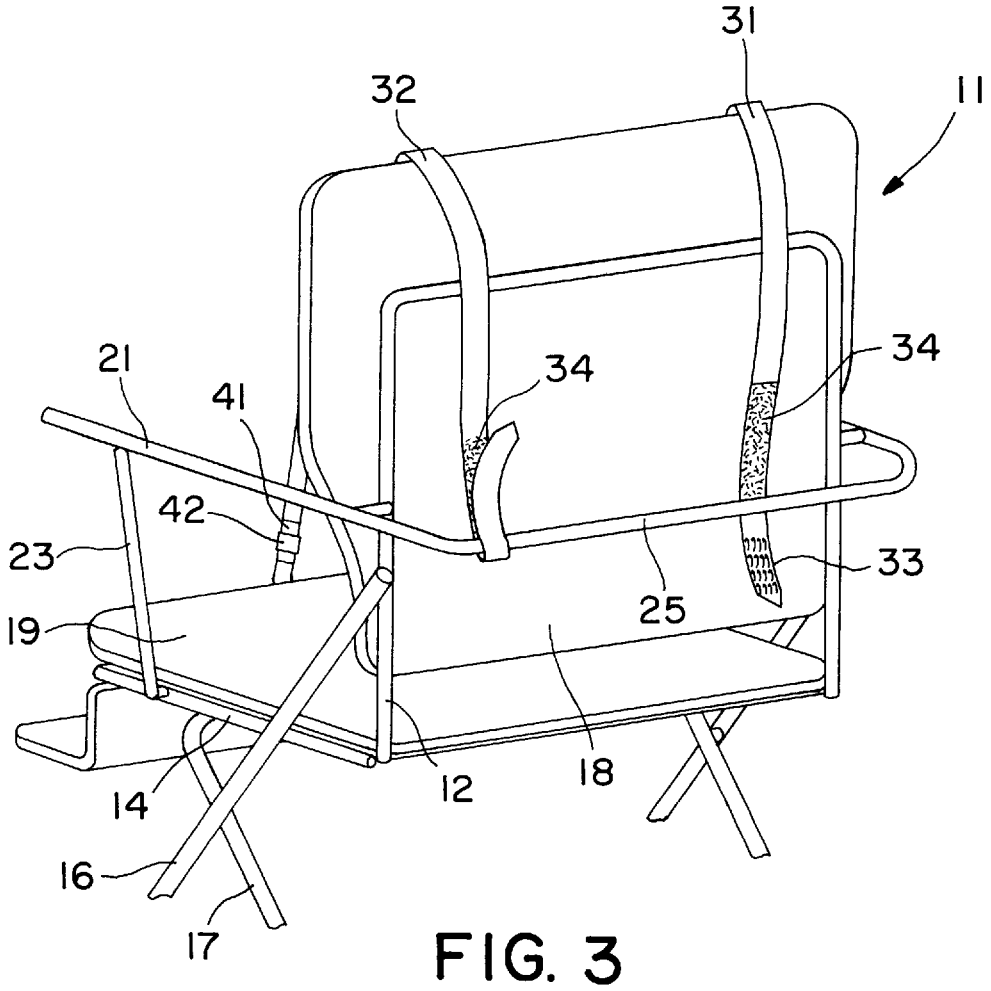
FIG. 3 is a fragmentary, rear perspective view of the chair with the safety harness attached.

As shown in FIGS. 1–3, the safety harness 10 includes first and second shoulder straps 31 and 32 for extending over the shoulders of the seated infant to the back side of the chair back 18. The free ends of the straps 31 and 32 preferably have mating hook and loop sections 33 and 34, shown in FIG. 3, to releasably secure the harness 10 to the attachment member 25. In an alternative embodiment, complementary button snaps are provided on free ends of the straps to secure the harness to the attachment member.

The area between the straps 31 and 32 forms an occupant space for accommodating the infant. When entering and exiting the chair 11, the occupant space is increased by sliding the straps 31 and 32 away from each other along the length of the attachment member 25. To restrain the infant in the chair 11, the occupant space is reduced by sliding the straps 31 and 32 towards each other.

A restraint adjustment bar 35 has spaced-apart slots 36 and 37 receiving the shoulder straps 31 and 32, respectively, to attach the bar 35 to the safety harness 10. The bar 35 is slidable along the length of the straps 31 and 32 to further adjust the occupant space after the infant is comfortably seated in the chair 11. The slot 36 includes a divider 38 extending from one side of the slot 36 to the opposite side and integrally-formed with the bar 35. The divider 39 of the slot 37 is open at one end and relatively flexible to allow convenient detachment of the bar 35 from the strap 31. The bar 35 is preferably detached to maximize the occupant space when the infant is entering and exiting the chair 11.

Figure 4:
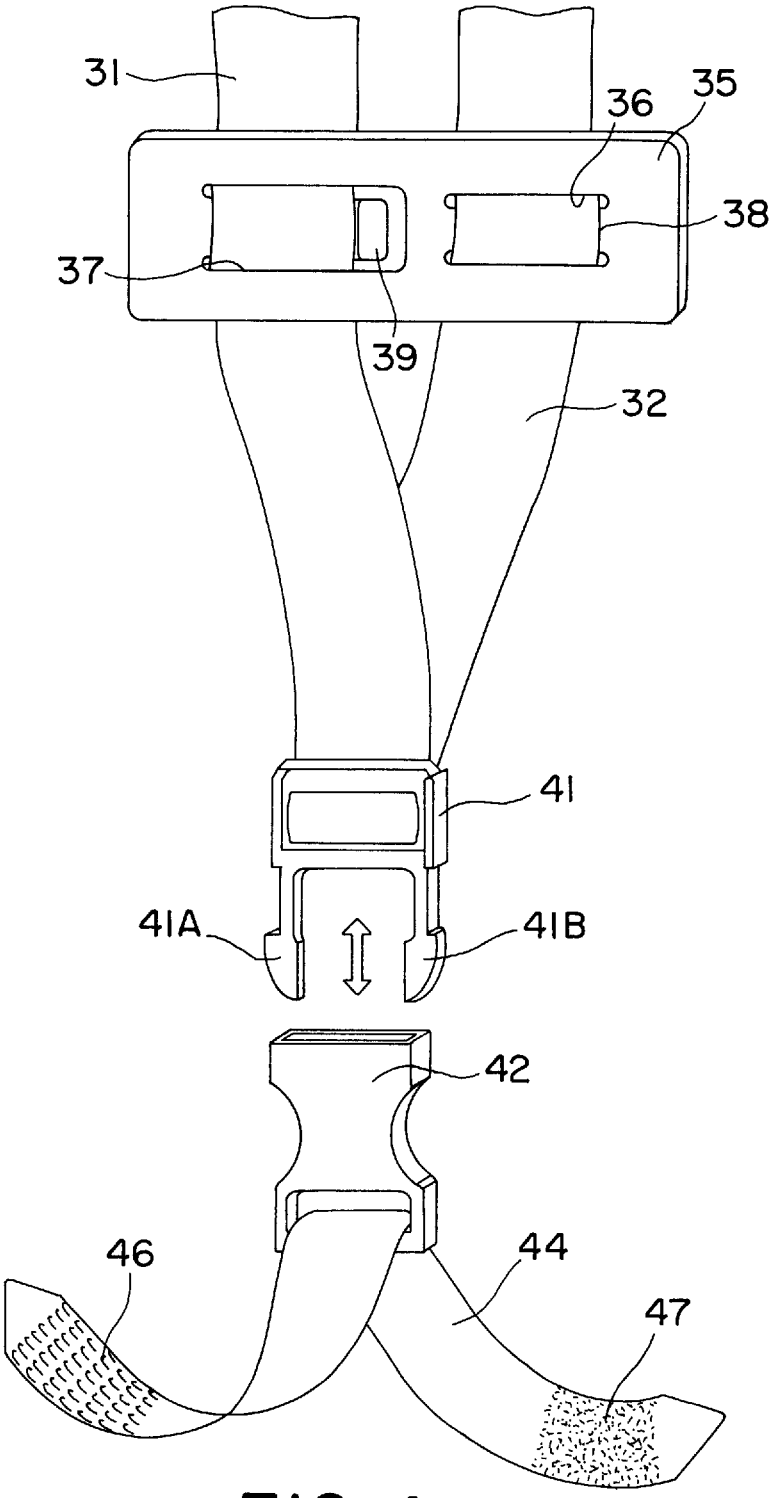
FIG. 4 is an enlarged fragmentary view of the shoulder straps and the between-the-legs attachment strap of the safety harness with the male and female fasteners detached.

As best shown in FIG. 4, the shoulder straps 31 and 32 are integrally formed together in a single length and folded at the center around a conventional male fastener 41. The male fastener 41 has resilient arms 41A, 41B adapted to releasably mate with a complementary female fastener 42 secured to a between-the-legs attachment strap 44. The attachment strap 44 is likewise formed of a single length which is folded at the center around the female fastener 42. The free ends of the attachment strap 44 preferably include respective hook and loop sections 46 and 47 to removably attach the strap 44 to the bottom frame member 14 of the chair 11 at the front of the chair bottom 19.

To facilitate entering and exiting the chair 11, the male and female fasteners 41 and 42 are preferably disconnected, as shown in FIG. 4, and the straps 31 and 32 lifted over the chair back 18 to hang from the attachment member 25. To apply the harness 10, after the infant is seated, the straps 31 and 32 are lifted over the chair back 18 and the shoulders of the infant, and the male and female fasteners 41 and 42 reconnected with the attachment strap 44 extending between the legs of the infant. The length of the attachment strap 44 may be adjusted by adjusting the attachment of the hook and loop sections 46 and 47 around the bottom frame member 14.

Alternatively, the between-the-legs attachment strap may be permanently connected to or integrally formed with the joined ends of the shoulder straps, and the shoulder straps permanently secured at opposite ends to the attachment member. In this case, adequate space required for the infant to enter and exit the chair is provided by detaching the restraint adjustment bar and sliding the shoulder straps away from each other along the length of the attachment member, as described above, to maximize the occupant space. To apply the harness, after the infant is seated, the shoulder straps are moved back towards each other and the restraint adjustment bar reattached to provide the desired occupant space for the infant.

Figure 5:
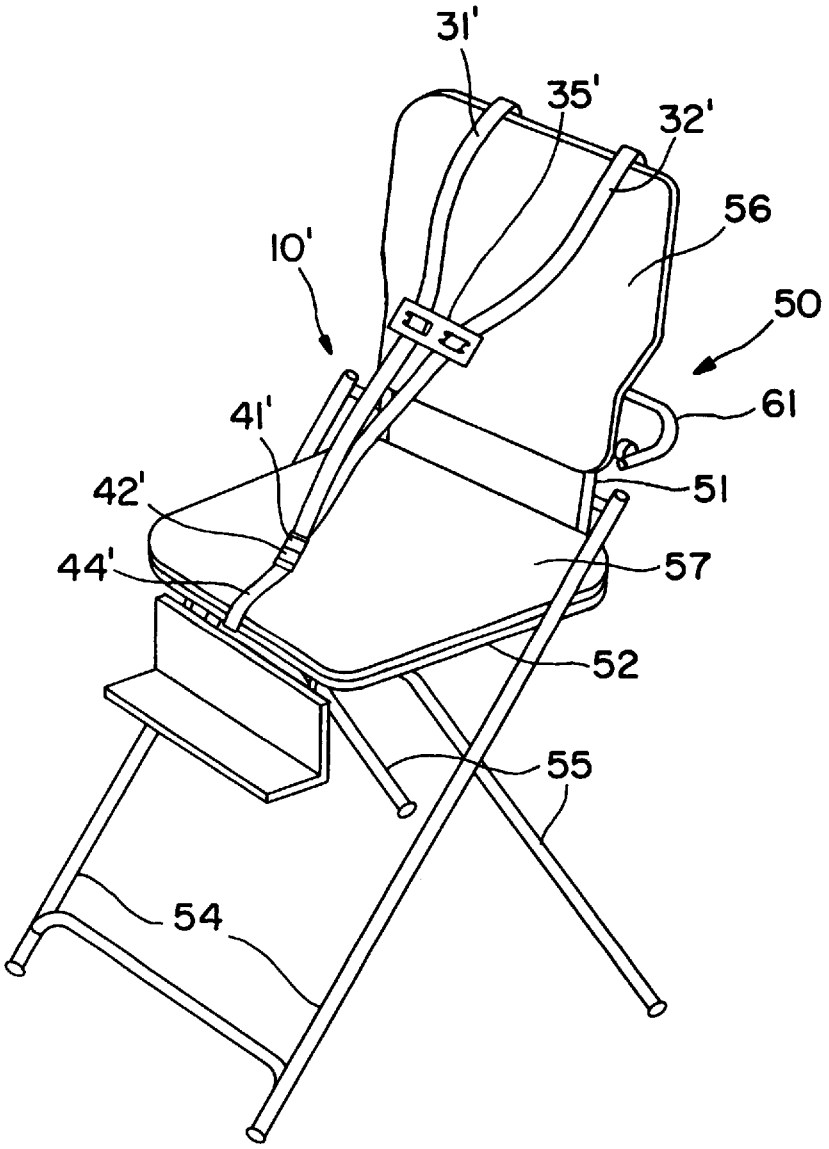
FIG. 5 is a perspective view of an infant's high chair according to a second embodiment and including the attached safety harness for confining the infant to the chair.
Figure 6:
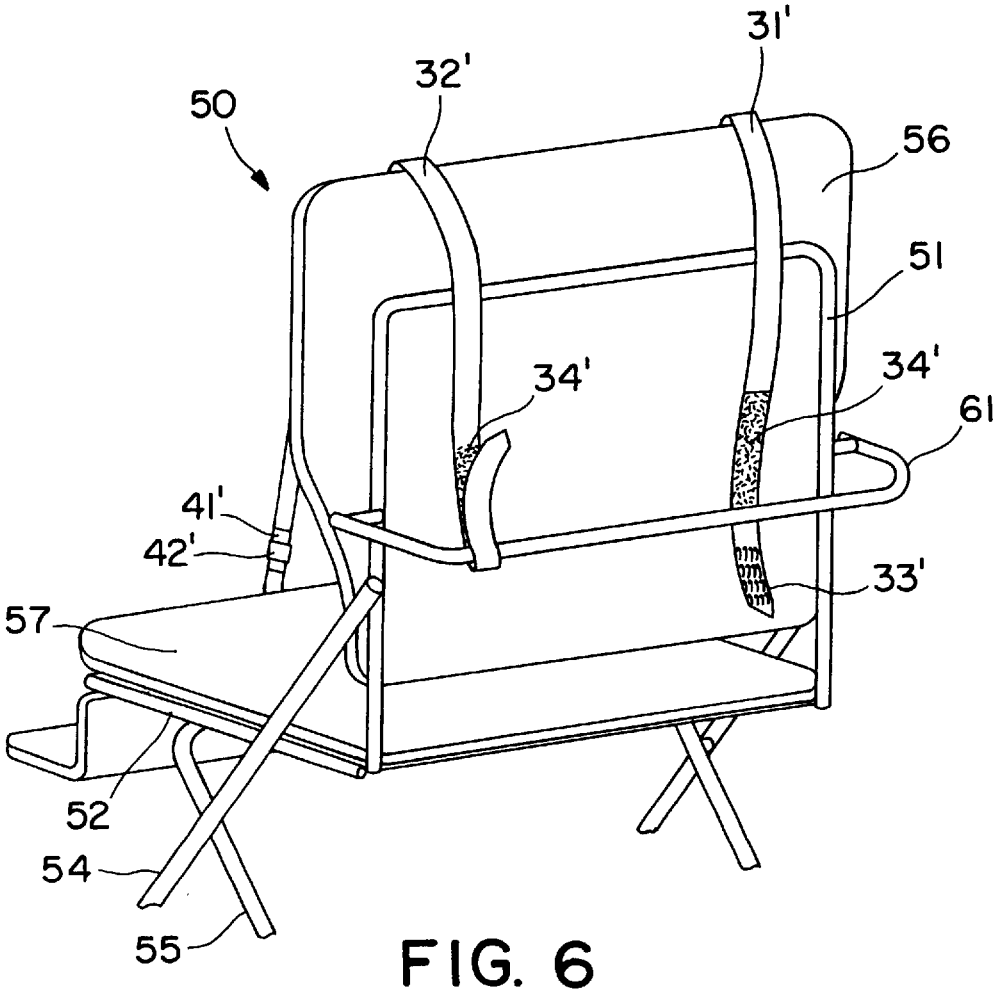
FIG. 6 is a fragmentary, rear perspective view of the chair shown in FIG. 5 with the safety harness attached.

A second embodiment of an infant's high chair 50 including a safety harness 10' of the present invention is shown in FIGS. 5 and 6. The chair 50 includes back and bottom generally C-shaped frame members 51 and 52 connected to front and rear sets of legs 54 and 55 and supporting the chair back 56 and chair bottom 57, respectively. A safety harness attachment member 61 is connected to the back frame member 51 and extends from one side of the chair back 56 to the other side. As best shown in FIG. 6, the attachment member 61 extends slightly outwardly from the rear of the chair back 56. The safety harness 10' is identical to that described above, and like elements are thus shown in prime notation. The harness 10' includes first and second shoulder straps 31' and 32' for extending over the shoulders of the seated infant to the back side of the chair back 18'. The free ends of the straps 31' and 32' preferably have mating hook and loop sections 33' and 34', shown in FIG. 6, to releasably secure the harness 10', to the attachment member 61. The free ends are relatively loosely attached to allow sliding movement of the straps 31' and 32' along the length of the attachment member 61.

A restraint adjustment bar 35' is slidable along the length of the straps 31' and 32' to further adjust the occupant space after the infant is comfortably seated in the chair 50. The bar 35' is preferably detached to maximize the occupant space when the infant is entering and exiting the chair 50.

The shoulder straps 31' and 32' are integrally formed together in a single length and folded at the center around a conventional male fastener 41'. The male fastener 41' is adapted to releasably mate with a complementary female fastener 42' secured to a between-the-legs attachment strap 44'. The attachment strap 44' is likewise formed of a single length which is folded at the center around the female fastener 42' and removably attached to the bottom frame member 52 of the chair 50 at a front end of the chair bottom 57.

A safety harness is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In combination with a chair having a back and a bottom, the improvement comprising an over-the-shoulder safety harness for restraining an occupant of the chair, said harness comprising:

(a) an elongated safety harness attachment member located on a back side of the chair back and extending from one side of the chair back to the other side of the chair back to define a length dimension;

(b) first and second shoulder straps adapted for extending over the shoulders of the occupant and having respective first and second ends thereof, the first ends being secured to the attachment member for slidably adjustable movement along the length of the attachment member;

(c) said first and second shoulder straps defining a laterally-extending occupant space therebetween, said occupant space being adjustable by sliding the first ends of the shoulder straps along the length of the attachment member, whereby the occupant space is reduced to further restrain the occupant by sliding the straps towards each other and is increased to remove the occupant from the chair by sliding the straps away from each other; and (d) a between-the-legs attachment strap attached to a front end of the chair bottom and secured to the second ends of said shoulder straps.

2. A combination according to claim 1, and comprising a restraint adjustment bar including spaced-apart slots receiving the first and second shoulders straps, respectively, and being slidably movable along the length of the straps for further adjusting the occupant space.

3. A combination according to claim 1, wherein the second ends of the shoulder straps are integrally formed together and include a fastener member for being releasably mated with a complementary fastener member connected to the between-the-legs attachment strap.

4. A combination according to claim 1, wherein the between-the-legs attachment strap includes first and second free ends having complementary mating hook and loop sections for removably attaching the attachment strap to the chair bottom.

5. A combination according to claim 1, wherein each of the first ends of the shoulder straps includes mating sections of hooks and loops for removably attaching the first ends to the attachment member.

* * * * *